US005370758A

United States Patent [19]

Bourjala et al.

[11] Patent Number: 5,370,758

[45] Date of Patent: Dec. 6, 1994

[54] METHOD OF PRODUCING SMALL CRATES OR OTHER PLASTIC RECEPTACLES BY ASSEMBLING SECTIONS WITH EXTRUDED PROFILES

[76] Inventors: Robert Bourjala, 24, rue Napoléon, 20200 Bastia; Pierre Giudicelli, Route du Village, 20600 Furiam; Pierre L. Agostini, Moison Massoni, 20221 Cervioni, all of France

[21] Appl. No.: 910,279

[22] PCT Filed: Nov. 15, 1991

[86] PCT No.: PCT/FR91/00907

§ 371 Date: Sep. 21, 1992

§ 102(e) Date: Sep. 21, 1992

[87] PCT Pub. No.: WO92/09488

PCT Pub. Date: Jun. 11, 1992

[30] Foreign Application Priority Data

Nov. 21, 1990 [FR] France ..... 90 14500

[51] Int. Cl.[5] ..... B29C 47/00

[52] U.S. Cl. ..... 156/73.1; 156/227; 156/244.11; 156/244.18; 156/244.19; 156/244.22; 156/252; 156/253; 156/256; 156/257; 156/268

[58] Field of Search ..... 156/227, 244.11, 244.18, 156/244.19, 244.22, 73.1, 252, 253, 256, 257, 268; 220/6, DIG. 14, DIG. 25

[56] References Cited

U.S. PATENT DOCUMENTS

| | | | |
|---|---|---|---|
| 2,952,039 | 9/1960 | Jaffe | 156/244.18 |
| 3,935,357 | 1/1975 | Padovani | 428/166 |
| 4,816,093 | 3/1989 | Robbins | 156/227 |

FOREIGN PATENT DOCUMENTS

| | | |
|---|---|---|
| 2147187 | 3/1973 | France . |
| 0044943 | 11/1974 | Japan . |
| 0011180 | 1/1979 | Japan . |
| 0152020 | 11/1980 | Japan . |
| 6612391 | 3/1968 | Netherlands . |
| 1470583 | 4/1977 | United Kingdom . |

*Primary Examiner*—Caleb Weston

*Attorney, Agent, or Firm*—Pearne, Gordon, McCoy & Granger

[57] ABSTRACT

A method is provided for producing plastic containers such as crates by assembling two shaped sections (7) forming opposite ends (5d and 5e) of the container along with a shaped section (1) forming the sides (5b and 5c) and the bottom (5a) thereof. Said shaped sections (7 and 1) are obtained by extruding, punching and cutting plastic material.

10 Claims, 4 Drawing Sheets

METHOD OF PRODUCING SMALL CRATES OR OTHER PLASTIC RECEPTACLES BY ASSEMBLING SECTIONS WITH EXTRUDED PROFILES

The present invention concerns a method to series produce a plastic receptacle with the overall shape of a parallelpiped and able to be used as a small crate for the handling, packaging and transportation of agricultural products, such as fruit or vegetables.

There currently exist several types of crates with variable dimensions and composed of diverse materials, such as wood, cardboard or plastic materials, such as vinyl polychloride, polyethylene, polypropylene and expanded polystyrene, all these materials being cited as examples. Crates made of wood or cardboard have on usage two major drawbacks. The first one is their permeability to water which firstly significantly reduces the mechanical resistance of the crates and secondly considerably alters the weight of the tare constituting said crates. The second drawback resides in the fact of their inflammability and the risks inherent of this characteristic concerning storage, whether the crates be empty or full. So as to mitigate these drawbacks, users would like to be able to replace cardboard or wooden crates with impermeable plastic and preferably non-inflammable crates. However, existing plastic crates do have the drawback of being much more expensive than wooden or cardboard crates. It is well-known that this extra cost is due far less to the cost of the plastic material than to its transformation into a finished product. In fact, plastic material transformation methods used to industrially produce crates or similar shaped receptacles are currently thermoforming, pressing-moulding or via injection and rotational plastic moulding, that is methods with discontinuous production requiring a long expensive production time. The purpose of the present invention is to overcome this drawback by reducing the cost of transformation of the plastic material into a finished product into the form of a crate or other receptacle. The principle retained to reduce this transformation cost is to significantly increase the production flowrate of crates or other receptacles by using the continuous transformation method of the plastic materials represented by extrusion, said method requiring with equal productivity an investment in machines and tools significantly lower than that for machines and tools used in the above-mentioned discontinuous transformation methods and in particular for producing a large number of plastic crates or other plastic receptacles.

The present invention concerns a method to produce plastic crates or other plastic receptacles at a high flowrate by mounting, possibly automated, of two or several types of perforated or truncated extruded profiles with suitable shapes and mechanical properties.

Figure 1:
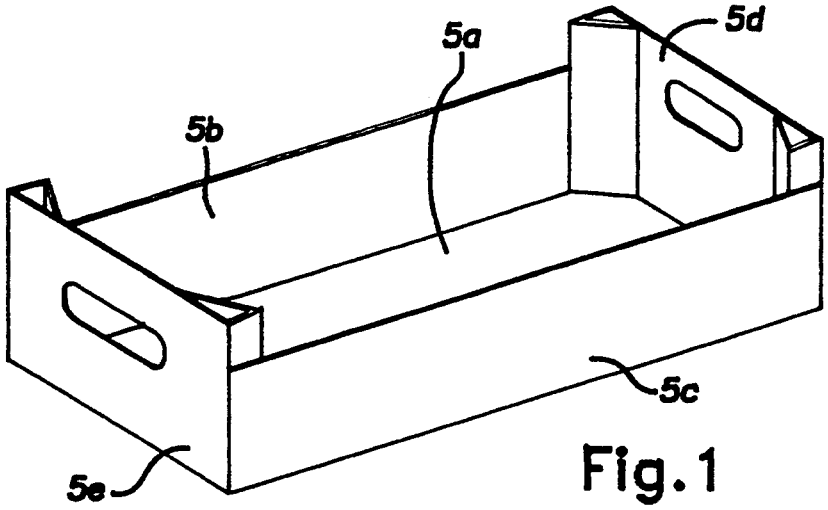
Figure 2:
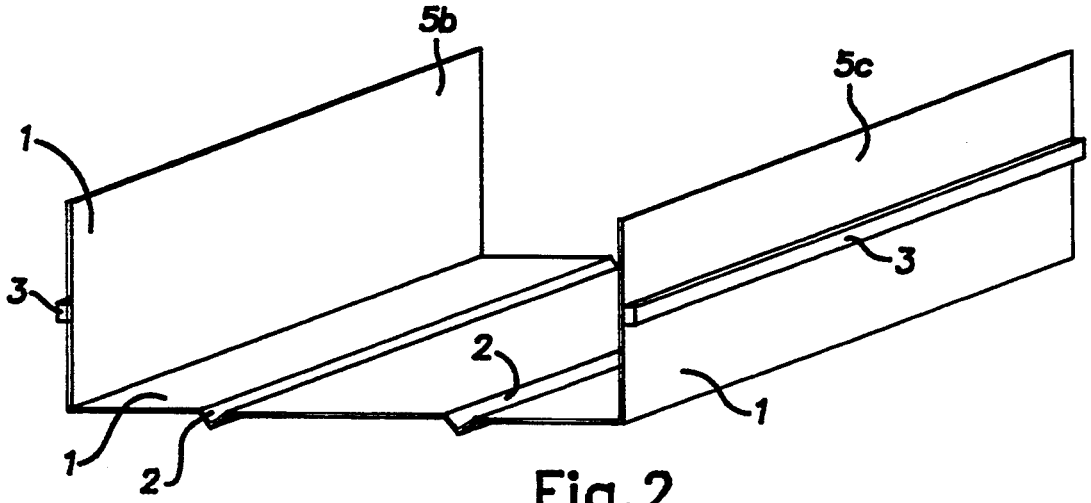
Figure 3:
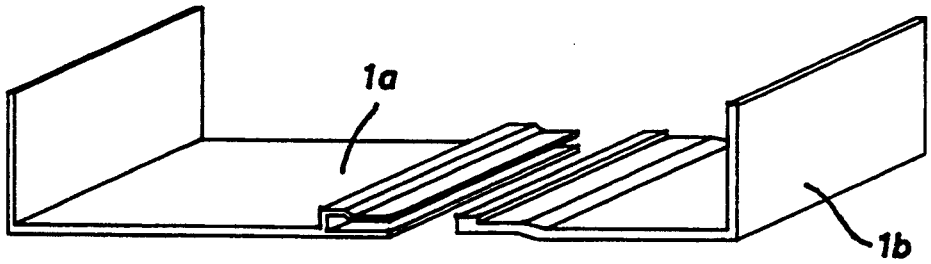
Figure 4:
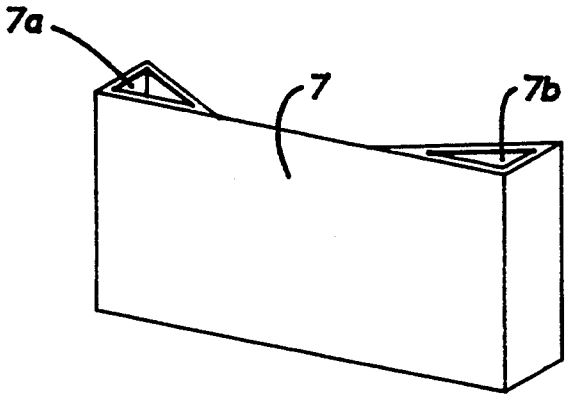

The present invention shall be more readily understood on reading the relevant details of the following description with reference to figures of the attached diagrams, namely:

FIG. 1 shows an overall view of the plastic crate or receptacle 5 to be produced and which comprises a bottom 5*a* and four sides 5*b*, 5*c*, 5*d* and 5*e*, FIG. 2 shows the shape the profile may assume with one section 1 intended to form the bottom 5*a* and two opposing sides 5*b* and 5*c* of the plastic crate or receptacle 5, FIG. 3 shows the shape the profile may assume with two sections 1*a* and 1*b* intended to form the bottom 5*a* and two opposing sides 5*b* and 5*c* of the plastic crate or receptacle, FIG. 4 shows the shape the profile 3 may assume with two sections intended to form the two sides 5*d* and 5*e* of the plastic crate or receptacle 5.

Figure 5:
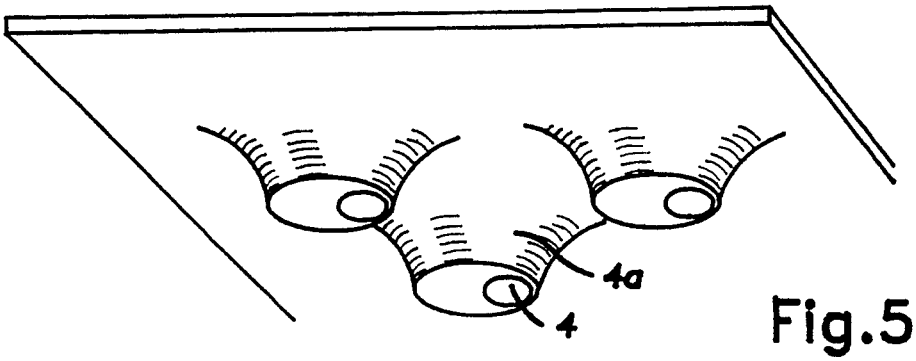
Figure 6:
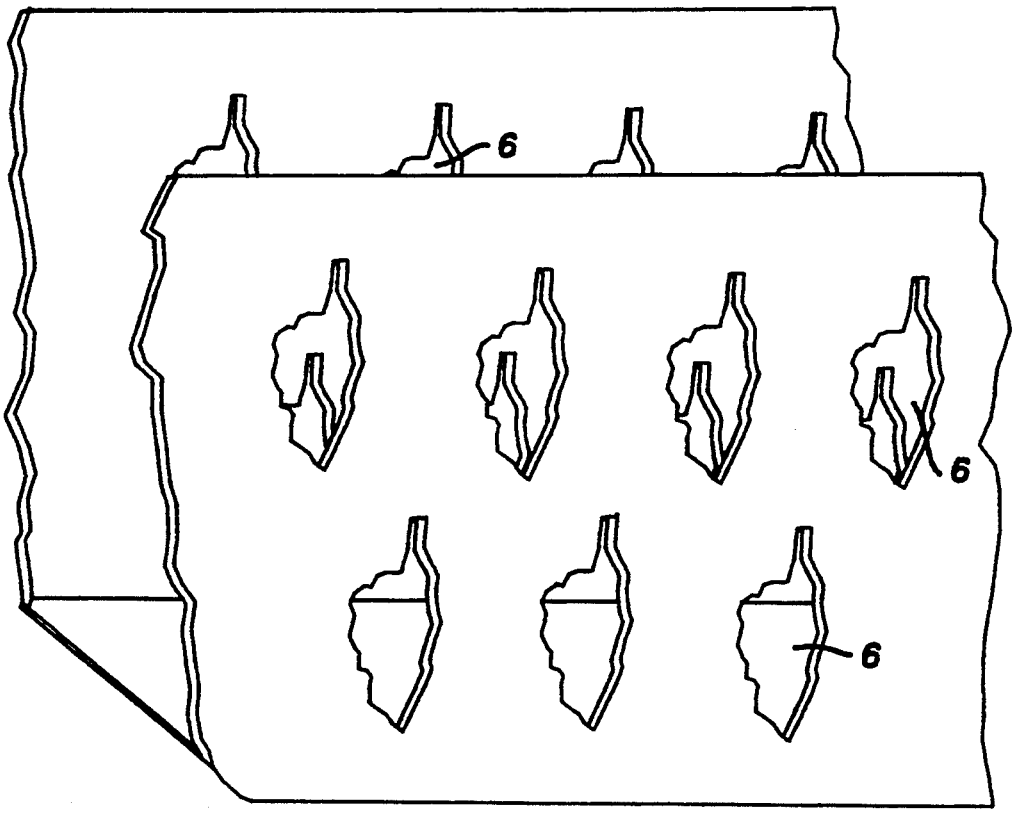

FIG. 5 shows a perforation example 4 of the surface of any one of the sides 5*b* and 5*c* or of the bottom 5*a* of the plastic crate or receptacle 5 to be produced, FIG. 6 shows another perforation example 6 of the surface of any one of the sides 5*b* and 5*c* or the bottom 5*a* of the plastic crate or receptacle to be produced.

Figure 7:
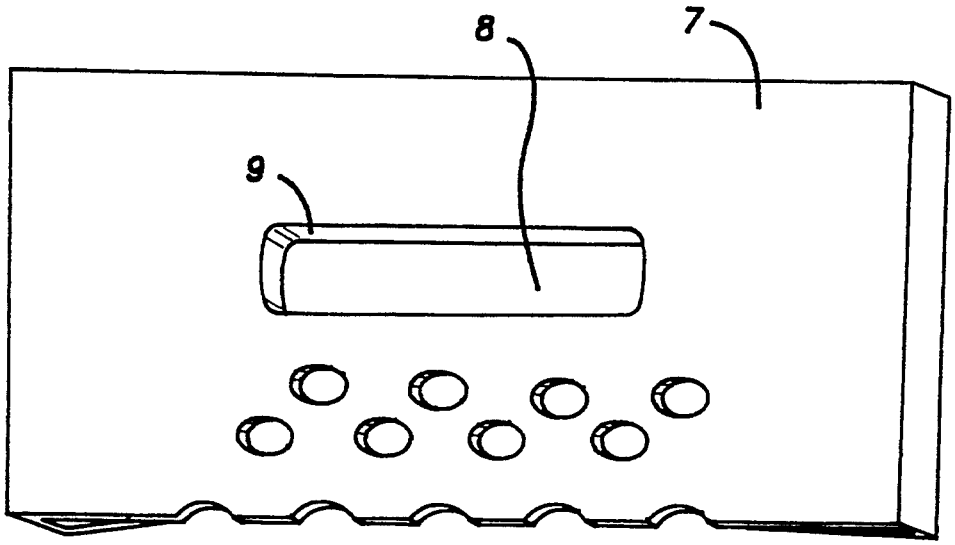
Figure 8:
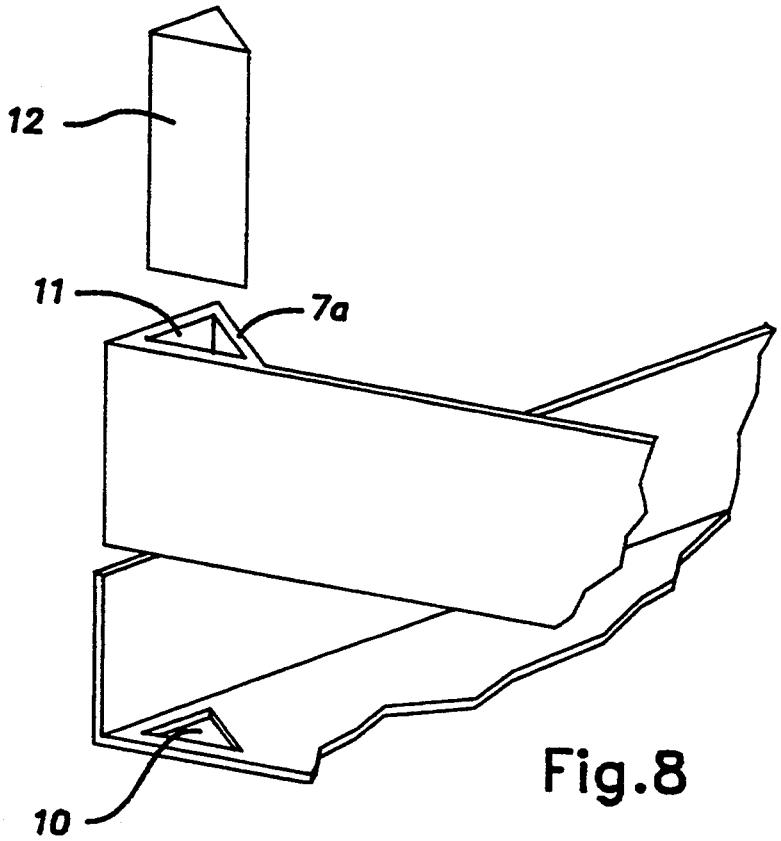

FIG. 7 shows a perforation example of any one of the sides 5*d* and 5*e* of the plastic crate or receptacle to be produced, FIG. 8 shows one particular detail of a border 7*a* of the profile 7 and the possibility to use a pile-up pin 12.

As shown on FIG. 2 and according to a particular main embodiment, a profile section 1, produced by the extrusion of a plastic material through a die and a device to produce the appropriate shapes, has a U-shaped cross section whose two branches forming the lateral sides 5*b* and 5*c* are perpendicular to the side forming the bottom 5*a*. Said lateral sides 5*b* and 5*c* and said bottom 5*a* may comprise on their two faces, or solely on one face, longitudinal reinforcing grooves 2 or longitudinal reinforcing ribs 3, or even a combination of said grooves and ribs. The length of the profile section 1 represents the total length of the plastic crate or receptacle 5 to be produced, this length possibly being 60 cm.

Alternatively, the bottom 5*a* and the lateral sides 5*b*, 5*c* may be obtained from a flat extruded profile folded along two longitudinal grooves.

In one example of a secondary embodiment shown on FIG. 3, the profile section 1 may be constituted by the longitudinal juxtaposition of at least two sections 1*a* and 1*b*, said sections 1*a* and 1*b* being able to be assembled, for example, via the longitudinal sliding of one into the other or by one being clipped into the other. Should the elements of the crate or receptacle need to be transported to a distant assembly site, this secondary embodiment has the advantage of reducing the cost of said transport by limiting the transported volume for a given number of crates or receptacles. In fact, the stacking of L-shaped profiles, such as that of the sections 1*a* and 1*b*, allows less empty spaces than would be the case with the stacking of U-shaped profiles, such as the profile section 1.

Once the profile section 1 described in the main embodiment has been extruded and significantly cooled, its surface is then perforated so as to firstly lighten the finished product, secondly reduce the cost of production by recycling the material fragments produced by this perforation and thirdly significantly increase the rigidity of the sides 5*a*, 5*b* and 5*c*. The increasing of the rigidity of the sides 5*a*, 5*b* and 5*c* mentioned above derives from the stretching of the material carried out during perforation at the periphery of the perforated orifice and which induces a traction prestressing in said sides. FIG. 5 shows the details of a perforation example 4 perforated by a punch with a circular section and reveals a stretching cone 4*a* which contributes in stiffening the perforated side. There are many perforation shapes enabling these aims to be achieved and a judicious choice of the drawing represented by the contour of certain perforations may provide the latter with an additional role in representing a brand image or original indication. By way of a non-restrictive example shown on FIG. 6, perforations 6 forming the silhouettes of Corsica on the sides of a crate of citrus fruits may contribute in promoting the products from this island.

The sides 5*d* and 5*e* of the plastic receptacle or crate are each produced by extrusion, the perforation and sectioning of a profile 7 being shown on FIG. 4. Said profile section 7 is longitudinally limited by two hollow borders 7*a* and 7*b* with a preferably triangular section but possibly rectangular or comprising a curved side. The faces of this profile section 7 may be provided with longitudinal stiffening ribs or grooves similar to the grooves 2 and the ribs 3 described earlier. The borders 7*a* and 7*b* are intended to firstly allow for a linking of the sides 5*d* and 5*e* with the sides 5*b* and 5*c* by an assembling device to be described subsequently, and secondly to support the vertical gravimetric load resulting from the stacking of the crates or receptacles. By way of example, the gravimetric load to be supported for the lower crate in a stacking of eleven crates filled with citrus fruits is about 120 kg. The length of the profile section 7 represents the height of the sides 5*d* and 5*e* of the plastic crate or receptacle to be produced; this length may be 17 cm. According to one particular embodiment of the invention, described hereafter with details illustrated on FIG. 8, another advantageous characteristic may be conferred on the plastic crate or receptacle by virtue of the use of four borders 7*a* or 7*b* which the plastic crate or receptacle comprises. It merely suffices to provide a perforation 10 on one or several of the portions of the bottom 5*a* intended to coincide with one or several of the border sections 7*a* or 7*b* so that one or several of the borders 7*a* or 7*b* enable a pin 12 to slide into their hollow portion 11, which then serves as a sheath, said pin 12 constituted by a profile with a appropriate section, said profile possibly being obtained by the extrusion of a rigid plastic material. The pin 12 is intended to allow for and maintain a vertical alignment of the stacked crates at the time they are stored and transported. The length of the pin 12 is preferably greater than the height of one crate and smaller than the height of two stacked crates for reasons of a limited small spatial requirement and so as to enable the upper crate to be taken from a pile whilst keeping the lower stacking aligned. However, this pin height may also be much greater than the height of two stacked crates.

Once the profile 7 has been extruded and significantly cooled, its surface is subjected to two types of perforations, the first type being similar to the one described on the profile section 1, the second type being specific to said profile 7 and made so as to provide spaces in the sides 5*d* and 5*e* said profile is to constitute, said spaces allowing for manual taking as regards the handling of the plastic crates or receptacles. One non-restrictive example of such a perforation is shown on FIG. 7. A perforated opening 8 allows for the passage of at least four fingers of a hand so as to facilitate handling of the crate, the material stretched by the perforation serving as an edge 9, said edge enabling the load of the crate to be distributed on a picking up surface larger than the one the sole thickness of the side 5*d* or 5*e* would generate concerning the length of the opening 8.

According to one main preferred embodiment, the assembling of two profile sections 7 with one profile section 1 so as to constitute the crate 5 shown on FIG. 1 is effected by the automated hot glueing of the external surface portions 7*c* and 7*d* of the borders 7*a* and 7*b* onto the corresponding portions 5*f* and 5*g* of the internal surfaces of the sides 5*b* and 5*c*.

According to one secondary embodiment, the assembling of the two profile sections 7 with one profile section 1 is effected by the ultrasonic welding of the surface portions 7*c* and 7*d* to the portions 5*f* and 5*g*.

According to another embodiment, the assembling of the two profile sections 7 one one profile section 1 is effected by stapling the surface portions 7*c* and 7*d* to the portions 5*f* and 5*g*.

By way of non-restrictive example, the following description of the various stages for producing plastic crates or other receptacles shall make it easier to understand the advantages of the method of the present invention and appreciate its simplicity.

In one first production phase, the profile 7 is extruded, perforated and truncated with its sections being stored. Extrusion is effected with conventional extrusion means with a plastic profile, that is with the aid of an extruder provided with a suitable die and a sequence line including a conformation bench, a drawing bench and a cutting or sectioning bench. A hydraulic or pneumatic perforation bench is inserted between the conformation bench and the drawing bench and produces the perforations specific to the profile 7.

In a second production phase, the same extrusion line is used as the one used in the first phase after having replaced the die and the cooling jig so as to be able to produce the profile 1 and, after having modified the punches of the perforation bench, to produce the perforations specific to the profile 1.

In a third production phase, two profile sections 7 are assembled with a profile section 1 on an assembling bench, the feeding of the profile sections 7 being transversal with respect to the feeding of the profile sections 1 and the positioning of the profile sections 7 being effected after either the pre-sizing of their external surface portions 7*c* and 7*d* or prior to the stapling or ultrasonic welding of the portions 5*f* and 5*g* of the profile section 1 onto the portions 7*c* and 7*d* according to the selected assembling method.

We claim:

1. A method for producing plastic crates, each crate including a bottom, four sides, and four borders for linking the sides, comprising:

extruding at least a first and second profile of plastic material, said first profile having a first cross section and said second profile having a second cross section different from said first cross section, said first and second profiles providing said bottom, four sides and four borders;

cutting said profiles into a plurality of sections;

perforating at least one of said sections by punching so as to stretch the plastic material and generate a traction prestressing in said at least one section;

folding said sections of said first profile to form said bottom and two of said sides; and assembling said sections of said first and second profiles so as to form said crates; said sections of said second profile acting as said borders for linking said sides, said bottom, four sides and four borders of each crate being formed from assembled sections of said first and second profiles.

2. A method according to claim 1 wherein said second profile is extruded to include a hollow triangular form, said hollow triangular form acting as at least one of said borders for linking said sides.

3. A method for producing plastic crates, each crate including a bottom, four sides, and four borders for linking the sides, comprising:

extruding at least two profiles of a plastic material, said profiles providing said bottom, four sides and four borders;

cutting said profiles into a plurality of sections;

perforating at least one of said sections by punching so as to stretch the Plastic material and generate a traction prestressing in said at least one section; and assembling said sections so as to form said crates, wherein the four sides include a first and a second pair of opposite sides and the crates are obtained by extruding at least one first profile adapted to form the bottom and the first pair of opposite sides of each crate, by extruding a second profile adapted to form the second pair of opposite sides and the four borders of each crate, and by assembling at least one section of the first profile and two sections of the second profile, so as to form one crate.

4. A method according to claim 3, wherein said first profile is flat and includes two longitudinal folding grooves and the crates are obtained by folding said first flat profile along said grooves, before assembling the first profile sections and said second profile sections.

5. A method according to claim 3, wherein the crates are obtained by extruding two first profiles and by longitudinally juxtaposing and assembling sections of said first profiles, before assembling said assembled first profile sections and said second profile sections.

6. A method according to any one of claims 3 to 5, wherein said sections are assembled by gluing.

7. A method according to any one of claims 3 to 5, wherein said sections are assembled by ultrasonic welding.

8. A method according to any one of claims 3 to 5, wherein the profiles are successively produced on a single extrusion line, before assembling said sections.

9. A method according to claim 3, wherein portions of said sections adapted to form two opposite sides of each crate are perforated so as to provide openings allowing for the passage of a least four fingers of a hand.

10. A method according to claim 3, wherein at least one of said profiles is adapted to form said borders and said border-forming profile is extruded with a hollow form, and wherein at least one of said profiles is adapted to form said bottom and said bottom-forming profile is perforated at at least one location intended to be in alignment with said hollow form when assembling said sections.

* * * * *